US010364524B2

(12) United States Patent
Goshgarian et al.

(10) Patent No.: US 10,364,524 B2
(45) Date of Patent: Jul. 30, 2019

(54) LAUNDRY TREATING APPLIANCE WITH HELICAL CLUTCH

(71) Applicant: WHIRLPOOL CORPORATION, Benton Harbor, MI (US)

(72) Inventors: David Goshgarian, Benton Harbor, MI (US); Vetrivel Kanagaraj, Saint Joseph, MI (US); Bradley Morrow, Stevensville, MI (US); Kartik Vastrad, Pune (IN); Bret Wamhoff, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 462 days.

(21) Appl. No.: 15/094,387

(22) Filed: Apr. 8, 2016

(65) Prior Publication Data

US 2017/0292216 A1 Oct. 12, 2017

(51) Int. Cl.
*D06F 37/40* (2006.01)
*D06F 33/02* (2006.01)

(52) U.S. Cl.
CPC ..... *D06F 37/40* (2013.01); *D06F 33/02* (2013.01); *D06F 2204/06* (2013.01)

(58) Field of Classification Search
CPC ..... D06F 37/40; D06F 23/04; D06F 37/30; D06F 17/08; D06F 13/02; D06F 37/12; D06F 37/206; D06F 37/24; D06F 17/10
USPC ..... 68/23.7, 133, 12.24, 23.6, 140, 23.3, 68/23 R, 131, 132, 134; 192/81 C, 192/12 BA, 18 R, 26, 84.81, 69.8; 74/33, 74/126, 25, 7 C, 76, 15.63, 20, 21
See application file for complete search history.

(56) References Cited

U.S. PATENT DOCUMENTS

| | | | | |
|---|---|---|---|---|
| 2,191,609 A | | 2/1940 | Dodge | |
| 2,826,056 A | * | 3/1958 | Bruckman | D06F 13/02 192/18 R |
| 2,948,372 A | * | 8/1960 | Goodlaxson | D06F 37/36 192/18 R |
| 3,006,216 A | | 10/1961 | Sisson et al. | |
| 3,153,951 A | * | 10/1964 | Whelan | D06F 37/40 192/3.51 |
| 3,215,232 A | * | 11/1965 | Douglas | D06F 13/00 192/18 R |
| 3,576,117 A | * | 4/1971 | Cowan | D06F 37/30 192/93 R |
| 3,642,106 A | * | 2/1972 | Baer | F16D 27/105 192/26 |

(Continued)

FOREIGN PATENT DOCUMENTS

GB 1140607 A 1/1969

*Primary Examiner* — David G Cormier
*Assistant Examiner* — Thomas Bucci
(74) *Attorney, Agent, or Firm* — McGarry Bair PC

(57) ABSTRACT

A laundry treating appliance comprises a rotatable basket with a spin tube, a rotatable clothes mover located within the rotatable basket, a motor having a drive shaft extending through the spin tube and operably coupled to the clothes mover, and a drive system selectively rotatably coupling the spin tube and the drive shaft and comprising a first threaded ring located about the spin tube, a second threaded ring threaded about the first threaded ring wherein at least one of the first threaded ring and the second threaded ring is axially movable relative to the other, and a gear assembly rotationally coupled to the drive shaft.

22 Claims, 8 Drawing Sheets

(56) References Cited

U.S. PATENT DOCUMENTS 3,686,968 A * 8/1972 Ehrlenspiel ..... F16H 1/28 74/410
3,793,855 A * 2/1974 Sisson ..... D06F 13/00 68/23.7
3,845,642 A * 11/1974 Cochran ..... D06F 13/02 68/23.7
3,850,275 A * 11/1974 Helander ..... F16D 13/025 192/26
3,934,690 A * 1/1976 Janning ..... F16D 27/105 192/84.81
3,960,253 A * 6/1976 Sigg ..... F16D 11/10 192/69.9
4,030,584 A * 6/1977 Lowery ..... F16D 13/757 192/35
4,034,833 A * 7/1977 Jeter ..... F16H 19/025 188/82.84
4,059,975 A * 11/1977 Jacobs ..... D06F 37/40 192/51
4,088,210 A * 5/1978 Hoff ..... A01D 69/08 192/105 BA
4,122,928 A * 10/1978 Smith ..... F16D 43/208 192/56.56
4,165,624 A * 8/1979 Ruble ..... D06F 37/40 192/48.4
4,218,899 A * 8/1980 Mason ..... D06F 37/40 192/28
4,221,284 A * 9/1980 Hoff ..... F16D 13/08 192/12 BA
4,254,641 A * 3/1981 Gauer ..... D06F 37/40 188/166
4,255,952 A * 3/1981 Johnson ..... D06F 37/40 192/18 R
4,291,556 A * 9/1981 Mason ..... D06F 37/40 192/89.21
4,317,343 A * 3/1982 Gerry ..... D06F 37/40 192/18 R
4,330,054 A * 5/1982 MacDonald ..... F16D 13/025 192/18 R
4,371,067 A * 2/1983 Gerry ..... D06F 37/40 192/24
4,387,580 A * 6/1983 Kennedy ..... D06F 37/40 192/46
4,430,871 A * 2/1984 Brenner ..... D06F 37/40 68/12.25
4,563,786 A * 1/1986 Brunswick ..... F16D 3/12 68/23.7
4,566,295 A * 1/1986 Mason ..... F16D 11/16 68/12.01
4,673,073 A * 6/1987 Weatherby ..... F16D 43/18 192/103 B
4,803,855 A * 2/1989 Kennedy ..... D06F 37/40 464/160
4,813,248 A * 3/1989 Smith ..... D06F 37/304 192/85.18
4,890,465 A * 1/1990 Burk ..... D06F 37/40 464/160
4,910,979 A * 3/1990 Burk ..... D06F 37/40 68/133
4,953,369 A * 9/1990 Ito ..... D06F 37/40 192/17 R
4,969,341 A * 11/1990 Burk ..... D06F 37/40 192/108
5,000,016 A * 3/1991 Burk ..... D06F 37/40 68/23.7
5,018,611 A * 5/1991 Hasebe ..... F02N 15/023 192/42
5,033,278 A * 7/1991 Hossfield ..... D06F 37/40 188/166
5,099,974 A * 3/1992 Spechko ..... F16D 27/105 192/35
5,187,954 A * 2/1993 Kim ..... D06F 37/40 192/113.1
5,209,085 A * 5/1993 Brien ..... D06F 37/40 192/18 B
5,269,160 A * 12/1993 Wood ..... D06F 37/40 68/23.7
5,345,793 A * 9/1994 Sharp ..... D06F 37/40 475/345
5,373,715 A * 12/1994 Sharp ..... D06F 37/12 68/133
5,379,616 A * 1/1995 Bae ..... D06F 37/40 68/23.7
5,491,859 A * 2/1996 Richardson ..... D06F 37/40 68/133
5,509,284 A * 4/1996 Hauser ..... D06F 37/40 192/12 BA
5,522,242 A * 6/1996 Hauser ..... D06F 37/40 192/12 BA
5,551,261 A * 9/1996 Lyu ..... D06F 37/40 68/23.6
5,596,902 A * 1/1997 McMillen ..... F02N 15/063 464/46
5,720,065 A * 2/1998 Myers ..... D06F 37/40 68/12.02
5,732,574 A * 3/1998 Hauser ..... D06F 37/40 68/133
5,737,944 A * 4/1998 Nishimura ..... D06F 37/40 68/208
5,737,965 A * 4/1998 Crain ..... D06F 37/40 68/23.7
5,842,358 A * 12/1998 Koo ..... D06F 37/40 68/23.7
5,860,299 A * 1/1999 Eum ..... D06F 37/304 68/133
5,862,685 A * 1/1999 Lim ..... D06F 37/34 68/133
5,926,887 A * 7/1999 Thompson ..... D06F 37/40 192/12 BA
6,012,306 A 1/2000 Raes
6,015,032 A * 1/2000 McGourthy, Jr. ..... D06F 37/40 192/14
6,077,184 A * 6/2000 Lee ..... D06F 37/40 475/331
6,176,108 B1 * 1/2001 Bae ..... D06F 37/40 68/23.7
6,189,171 B1 * 2/2001 Savkar ..... D06F 37/40 68/133
6,244,078 B1 * 6/2001 Thompson ..... D06F 37/40 68/133
2003/0056554 A1 * 3/2003 Ahn ..... D06F 37/40 68/12.24
2003/0213271 A1 * 11/2003 Lim ..... D06F 37/40 68/23.3
2004/0163429 A1 * 8/2004 Lim ..... D06F 37/40 68/140
2005/0011233 A1 * 1/2005 Vaidhyanathan ..... D06F 37/145 68/23.7
2005/0120759 A1 * 6/2005 Choi ..... D06F 37/40 68/133
2005/0278869 A1 * 12/2005 Roepke ..... D06F 37/40 8/159
2006/0010612 A1 * 1/2006 Kim ..... D06F 37/36 8/158
2007/0006394 A1 * 1/2007 Chang ..... D06F 37/40 8/158
2008/0060388 A1 * 3/2008 Warmuth ..... D06F 37/00 68/140
2009/0145173 A1 * 6/2009 Seagar ..... D06F 37/40 68/12.16
2009/0211035 A1 * 8/2009 Kim ..... D06F 37/145 8/159
2012/0304704 A1 * 12/2012 Ponnaganti ..... D06F 37/40 68/140
2013/0139557 A1 * 6/2013 Chen ..... D06F 37/40 68/131
2013/0313068 A1 * 11/2013 Mevissen ..... B60K 25/00 192/81 C

(56) References Cited

U.S. PATENT DOCUMENTS

| | | | | |
|---|---|---|---|---|
| 2014/0000320 | A1* | 1/2014 | Chupka | D06F 37/40 68/132 |
| 2014/0069145 | A1* | 3/2014 | Chupka | D06F 37/40 68/12.24 |
| 2014/0165661 | A1* | 6/2014 | Chupka | D06F 33/06 68/133 |
| 2015/0211164 | A1* | 7/2015 | Kim | D06F 39/14 68/133 |
| 2015/0252507 | A1* | 9/2015 | Kim | D06F 17/08 68/23.6 |

* cited by examiner

LAUNDRY TREATING APPLIANCE WITH HELICAL CLUTCH

BACKGROUND OF THE INVENTION

Laundry treating appliances, such as washing machines, refreshers, and non-aqueous systems, can have a configuration based on a rotating container that at least partially defines a treating chamber in which laundry items are placed for treating. The laundry treating appliance may have a controller that implements a number of user-selectable, pre-programmed cycles of operation. Hot water, cold water, or a mixture thereof along with various treating chemistries may be supplied to the treating chamber in accordance with the cycle of operation.

Washing machines having a drive system between the motor and clothes mover and basket require a clutch mechanism so that the washing machine will be able to operate in an agitate mode wherein the agitator is oscillated while the basket is held stationary and in an extraction mode wherein the agitator and basket are spun together. The drive system can have several configurations such as direct or belt drive. Conventional washing machines can incorporate a spring clutch or a spline clutch with a solenoid to actuate the clutch, moving the clutch member vertically on the motor shaft to selectively engage or disengage a connection with the basket. Such spline clutches and solenoids are fairly expensive mechanisms.

BRIEF SUMMARY OF THE INVENTION

In one aspect, illustrative embodiments in accordance with the present disclosure relate to a laundry treating appliance including a rotatable basket with a spin tube, a rotatable clothes mover located within the rotatable basket, a motor having a drive shaft extending through the spin tube and operably coupled to the clothes mover, and a drive system selectively rotatably coupling the spin tube and the drive shaft. The drive system includes a first threaded ring located about the spin tube, a second threaded ring threaded about the first threaded ring, wherein at least one of the first threaded ring and the second threaded ring is axially moveable relative to the other, and a gear assembly rotationally coupled to the drive shaft. Rotation of the drive shaft is configured to axially move the one of the first threaded ring or the second threaded ring, and when either the first threaded ring or the second threaded ring abuts a stop, continued rotation in a same direction results in the spin tube and drive shaft being locked together for coupled rotary motion of the clothes mover and the basket.

In another aspect, illustrative embodiments in accordance with the present disclosure relate to a laundry treating appliance including a tub defining an interior, a basket with a spin tube located within the interior and rotatably mounted within the tub, and a clothes mover rotatably mounted within the basket. The laundry treating appliance further includes a motor having a drive shaft extending through the spin tube and operably coupled to the clothes mover to selectively oscillate or rotate the clothes mover, and a clutch assembly. The clutch assembly includes a first threaded ring provided about the spin tube and a second threaded ring operably coupled to the drive shaft and threaded about the first threaded ring. The first threaded ring and the second threaded ring can move relative to each other based on rotation of the drive shaft. The clutch assembly is configured to rotationally couple the clothes mover and the basket after the clothes mover has moved through a predetermined stroke angle.

In yet another aspect, illustrative embodiments in accordance with the present disclosure relate to a laundry treating appliance including a basket with a spin tube, a clothes mover rotatably mounted within the basket, and a motor having a motor input drivingly coupled to the clothes mover, through the spin tube, to selectively oscillate or rotate the clothes mover. The laundry treating appliance further includes a clutch assembly having a vertically moveable tang configured to move along an axial length, and a drive mechanism. The drive mechanism includes a sun gear operably connected with the motor, a plurality of planet gears driven by the sun gear, and a planet carrier rotatably driven by the plurality of planet gears and operably connected with the vertically moveable tang to move the vertically moveable tang along an axial length. The clutch assembly is configured to permit oscillatory motion of the clothes mover and rotary motion of the clothes mover and the basket. The clothes mover moves through an available oscillatory stroke angle before the clothes mover and the basket are locked together for rotary motion. The available oscillatory stroke angle corresponds to the vertically moveable tang moving along the axial length.

DETAILED DESCRIPTION OF EMBODIMENTS OF THE INVENTION

Figure 1:
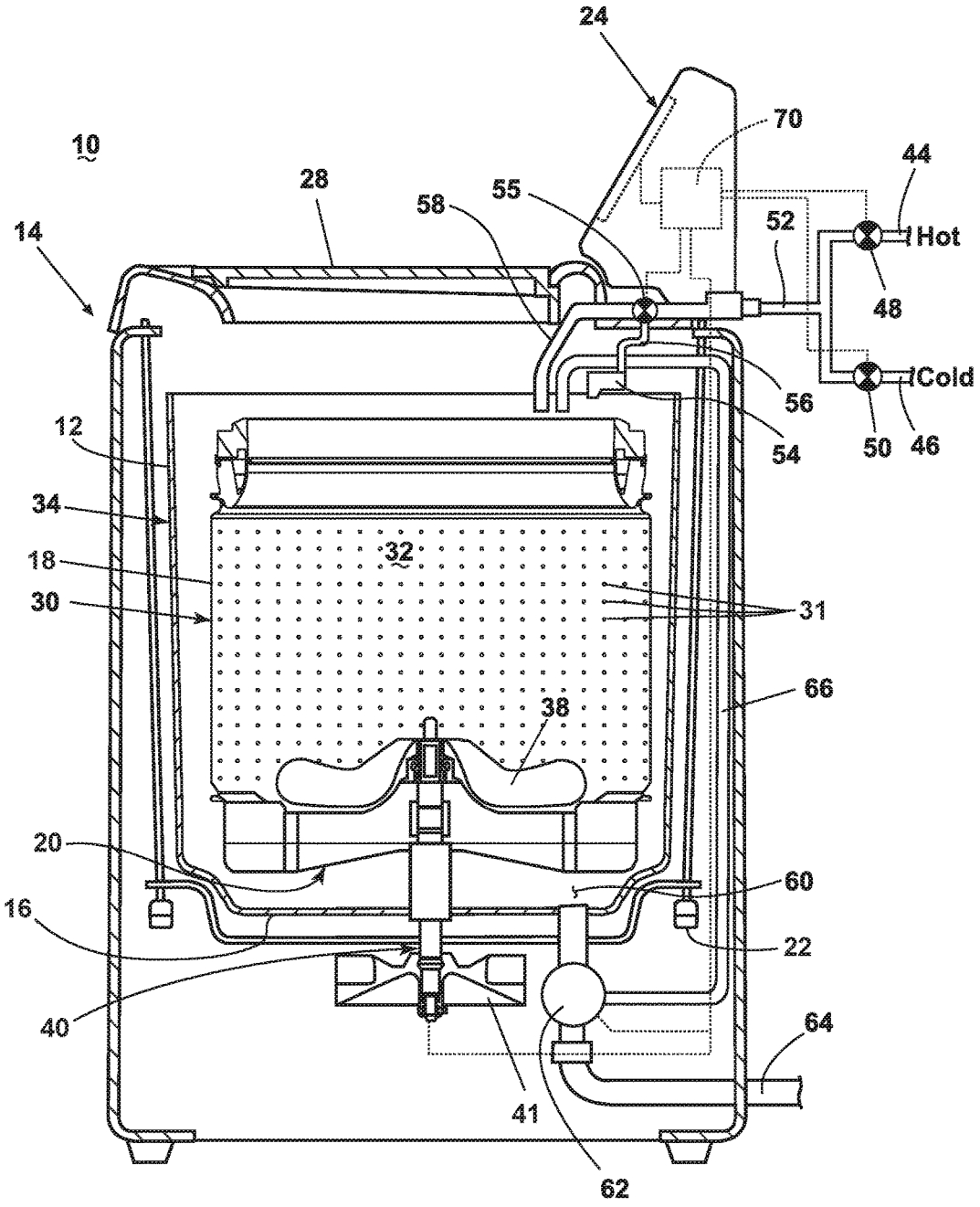
FIG. 1 illustrates a schematic cross-sectional view of a laundry treating appliance in the form of a washing machine according to one embodiment of the invention.

Illustrative washing machines in accordance with the present disclosure include a rotatable clothes mover and a rotatable basket. Clothes movers generally oscillate, or rotate back and forth in accordance with a stroke angle, to provide agitation to a laundry load during washing operations. Clothes movers and rotatable baskets generally spin together during spin cycle operations. To enable both of these functionalities—oscillation by the clothes mover and joint spinning by the clothes mover and basket—through a common drive system, washing machines may include a clutch mechanism. Such a clutch mechanism leaves the clothes mover and the rotatable basket uncoupled during oscillation of the clothes mover, but then couples the clothes mover and rotatable basket during spin cycle operations so that they spin together.

Clutch mechanisms may allow the clothes mover to oscillate up to a certain stroke angle while the clothes mover and the rotatable basket are uncoupled. Once the clothes mover rotates beyond that angle, clutch mechanisms may engage, resulting in rotational coupling of the clothes mover and the rotatable basket. However, typical clutch mechanisms are limited in that they may only allow 180-360 degrees of oscillatory rotation by the clothes mover—beyond this amount of rotation, the clothes mover and the rotatable basket will couple and spin together. This limits the available stroke angle for the clothes mover during agitation.

Clutch mechanisms in accordance with the present disclosure enable much larger stroke angles for clothes movers than conventional clutch mechanisms. The particular stroke angle enabled by implementations in accordance with the present disclosure will vary based on design parameters selected by a manufacturer, but may include stroke angles of 360 degrees or more, 720 degrees or more, or 1080 degrees or more.

These stroke angles are enabled by providing a first threaded ring coupled to a wash basket spin tube and a second threaded ring threadably engaged with the first ring. The first and second threaded rings are axially movable relative to one another in response to rotation of the drive shaft and/or clothes mover. In some illustrative implementations described below, the first threaded ring moves axially upwards and downwards, while in other illustrative implementations, the second threaded ring moves axially upwards and downwards. In either case, the first or second threaded ring axially moves until engaging a stop mechanism. Engagement with the stop mechanism results in rotational coupling of the clothes mover and wash basket. The manufacturer can determine the amount of rotation by the clothes mover that results in such rotational coupling by selecting design parameters, including the length of threaded portions disposed on the first and second threaded rings, the number of threads, and the pitch angle of the threads.

This is achieved by providing the clutch mechanisms with increased range of motion and functionality. After the clothes mover rotates by a certain angle, the clutch mechanism does not simply engage, but rather proceeds along an axial length. Continued rotation by the clothes mover may cause the clutch mechanism to continue traversing along an axial length. Only when the clutch mechanism engages a stop mechanism will continued rotation by the clothes mover cause engagement by the clutch, coupling the clothes mover and the rotatable basket. By varying the axial length provided on the clutch mechanism, one can vary the oscillatory stroke angle available to the clothes mover before the clutch mechanism engages.

Illustrative embodiments in accordance with the present disclosure include clutch mechanisms that have a helical configuration and different ranges of movement along an axial length. For example, a helical threaded ring clutch described below may include an available axial length corresponding to three full rotations of the clothes mover, enabling up to a 1080 degree stroke angle. Threaded helical clutch mechanisms that provide different ranges of movement along an axial length are in accordance with the present disclosure, as will be explained below.

FIG. 1 illustrates a schematic cross-sectional view of a laundry treating appliance shown in the form of a washing machine 10 according to one embodiment of the invention. While the laundry treating appliance is illustrated as a vertical axis, top-fill washing machine, the embodiments of the invention can have applicability in other fabric treating appliances, non-limiting examples of which include a combination washing machine and dryer, a refreshing/revitalizing machine, an extractor, or a non-aqueous washing apparatus.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

As illustrated in FIG. 1, the washing machine 10 can include a structural support system comprising a cabinet 14 that defines a housing, within which a laundry holding system resides. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the invention. The top of the cabinet 14 can include a selectively openable lid 28 to provide access into the laundry treating chamber 32 through an open top of the basket 30.

The fabric holding system of the illustrated exemplary washing machine 10 can include a rotatable basket 30 having an open top that can be disposed within the interior of the cabinet 14 and may define a treating chamber 32 for receiving laundry items for treatment. A tub 34 can also be positioned within the cabinet 14 and can define an interior within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations 31, such that liquid may flow between the tub 34 and the rotatable basket 30 through the perforations 31. While the illustrated washing machine 10 includes both the tub 34 and the basket 30, with the basket 30 defining the treating chamber 32, it is within the scope of the invention for the laundry treating appliance to include only one receptacle, with the receptacle defining the laundry treatment chamber for receiving the load to be treated.

A clothes mover 38 may be rotatably mounted within the basket 30 to impart mechanical agitation to a load of laundry placed in the basket 30. The clothes mover 38 can be oscillated or rotated about its axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the clothes mover 38 may be driven by a drive system 40 that includes a motor 41, which can include a gear case, operably coupled with the basket 30 and clothes mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch 100 (FIGS. 3, 4, 5A-5D) can be included in the drive system 40 and can selectively operably couple the motor 41 with either the basket 30 and/or the clothes mover 38.

A suspension system 22 can dynamically hold the tub 34 within the cabinet 14. The suspension system 22 can dissipate a determined degree of vibratory energy generated by the rotation of the basket 30 and/or the clothes mover 38 during a treating cycle of operation. Together, the tub 34, the basket 30, and any contents of the basket 30, such as liquid and laundry items, define a suspended mass for the suspension system 22.

A liquid supply system can be provided to liquid, such as water or a combination of water and one or more wash aids, such as detergent, into the treating chamber 32. The liquid supply system can include a water supply configured to supply hot or cold water. The water supply can include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the housing 14.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, and recirculation and drain system are shown for exemplary purposes only and are not limited to the systems shown in the drawings and described above. For example, the liquid supply, recirculation, and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. The control system can further include a user interface 24 that is operably coupled with the controller 70. The user interface 24 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
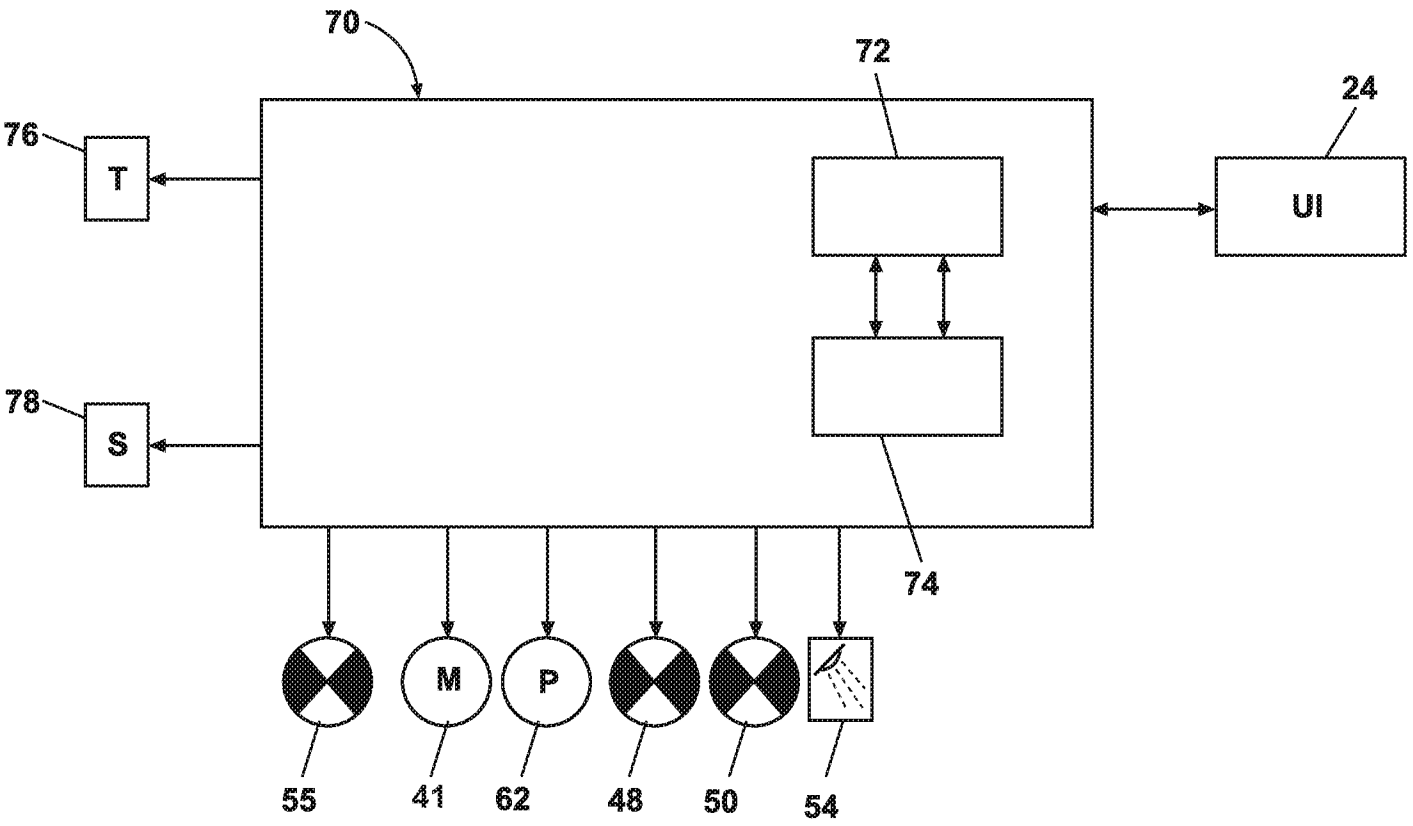
FIG. 2 illustrates a schematic representation of a controller for controlling the operation of one or more components of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 24. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including a motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

Figure 3:
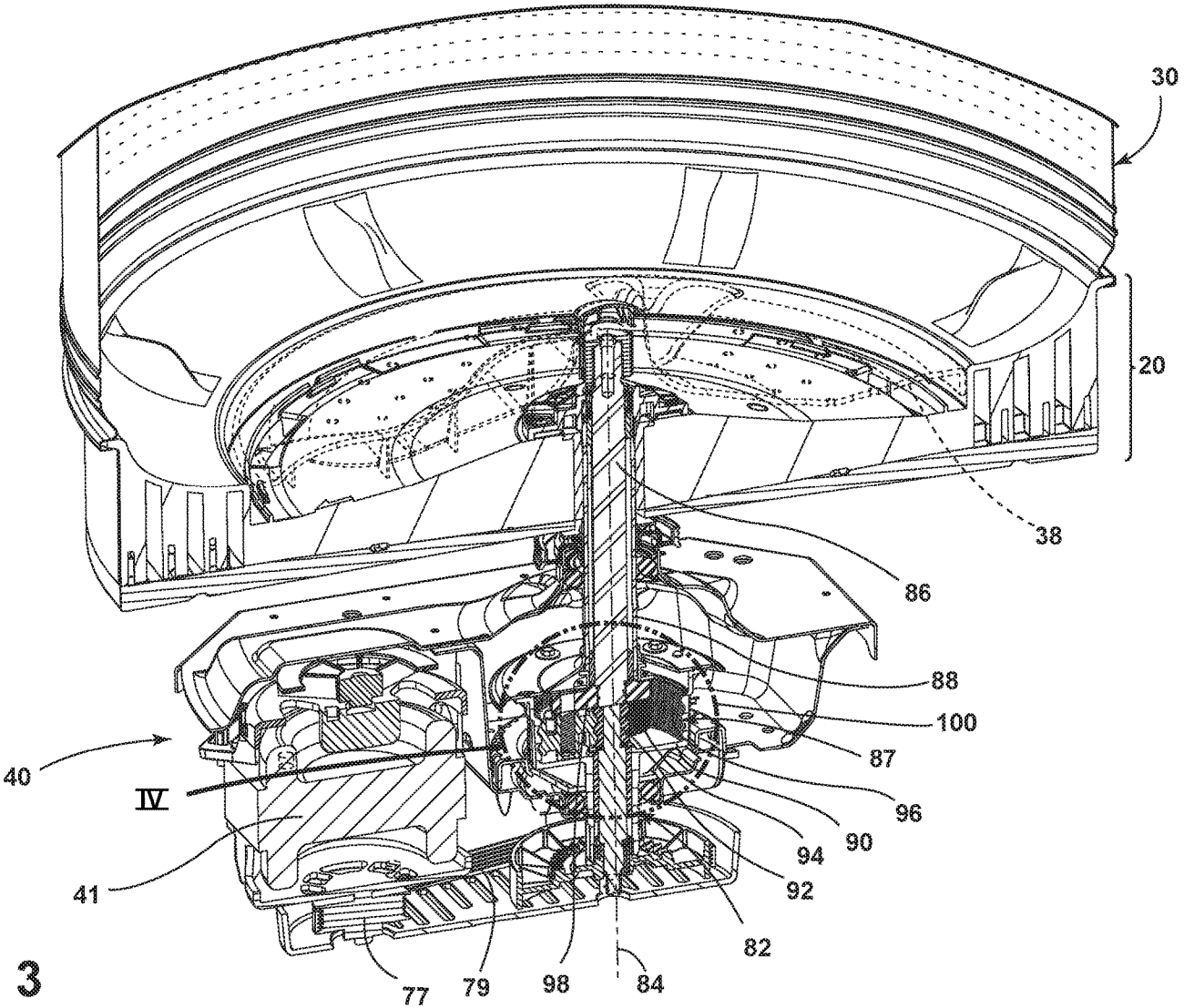
FIG. 3 illustrates a perspective view of a portion of a basket, impeller, drive system, and loss motion device that can be included in the laundry treating appliance of FIG. 1 in accordance with the present disclosure.

The basket 30, clothes mover 38, and drive system 40 are shown in greater detail in FIG. 3. The motor 41 can be drivingly coupled to the clothes mover 38 to selectively oscillate or rotate the clothes mover 38. More specifically, the motor 41 can include an output 77 that is connected through a belt system 79 to an output drive shaft 82 configured to rotate about an axis of rotation 84. Alternatively, the motor 41 could be directly connected to the output drive shaft 82. The output drive shaft 82 can further include a first drive shaft 86 configured to couple with and rotate the clothes mover 38 and a second drive shaft, which is illustrated as a spin tube 88, configured to couple with and rotate the basket 30. As shown, the first drive shaft 86 can be concentric to, and positioned within the interior diameter of the spin tube 88. Each of the drive shaft 86 and spin tube 88 can be configured to rotate, for example, independently of the other, in unison with the other, or at dissimilar rotational speeds or directions from the other.

The drive system 40 can further include a planetary drive mechanism having a planetary gear system or mechanism, illustrated as a planetary gearbox 87. The planetary gearbox 87 can include a gearbox housing 90, a sun gear 92, a set of planet gears 94, and an outer concentric ring gear 96, wherein the gears 92, 94, 96 are positioned within the housing 90. The sun gear 92 is rotationally coupled with the drive shaft 82, and includes gears configured to mesh with and rotate the set of planet gears 94 positioned concentrically about the sun gear 92 and within the outer ring gear 96. Each of the planet gears 94 is coupled with a planet carrier 98 such that the rotation of the planet gears 94 about the ring gear 96, as driven by the sun gear 92, rotates the planet carrier 98 about the axis of rotation 84. The planet carrier 98 can be further coupled with the first drive shaft 86 to rotate the clothes mover 38. The ring gear 96 is operably connected with the basket 30 via the spin tube 88. The sun gear 92, planet gears 94 and outer ring gear 96 can be collectively thought of as a gear assembly.

The planetary gearbox 87 can be configured in any suitable manner including that it can be configured in a speed-reducing configuration, for example by planetary gear reduction, such that the output rotational speed of the first drive shaft 86 is less than the rotational speed of the output drive shaft 82. The planetary gearbox 87, sun gear 92, planet gears 94, ring gear 96, and the like, can be configured or selected to provide a desired rotational speed—reducing ratio based on the rotational speed of the drive shaft 82, the desired rotational speed of the clothes mover 38, or the desired agitation of the washing machine 10 or the cycle of operation. Alternatively, embodiments of the disclosure are envisioned wherein the motor 41 does not include a gearbox, and the drive shaft 82 is directly coupled with at least one of the first drive shaft 86 or spin tube 88.

The motor 41 operates as controlled by the controller 70. The rotational speed of the drive shaft 82 can be reduced by the planetary gearbox 87 and delivered to the clothes mover 38 to rotate the clothes mover 38, which ultimately provides movement to the laundry load contained within the laundry treating chamber 32. When the washer is operating in the agitate mode, the motor 41 is operated in a reversing fashion which causes the drive shaft 82 to oscillate, thus driving the sun gear 92 in alternating opposite directions. The clothes mover 38 is therefore oscillated through its connection with the planet gears 94. The wash basket 30 can be held stationary while the clothes mover 38 is oscillated, for example by means of a brake mechanism (not shown).

A clutch mechanism 100 is included and allows for switching the washing machine 10 between a mode in which the clothes mover 38 oscillates relative to the basket 30 and a mode in which the clothes mover 38 and the basket 30 rotate together. In exemplary implementations, the clothes mover 38 may oscillate during a wash cycle to provide agitation, and the clothes mover 38 and the basket 30 may spin together during a spin cycle.

Figure 4:
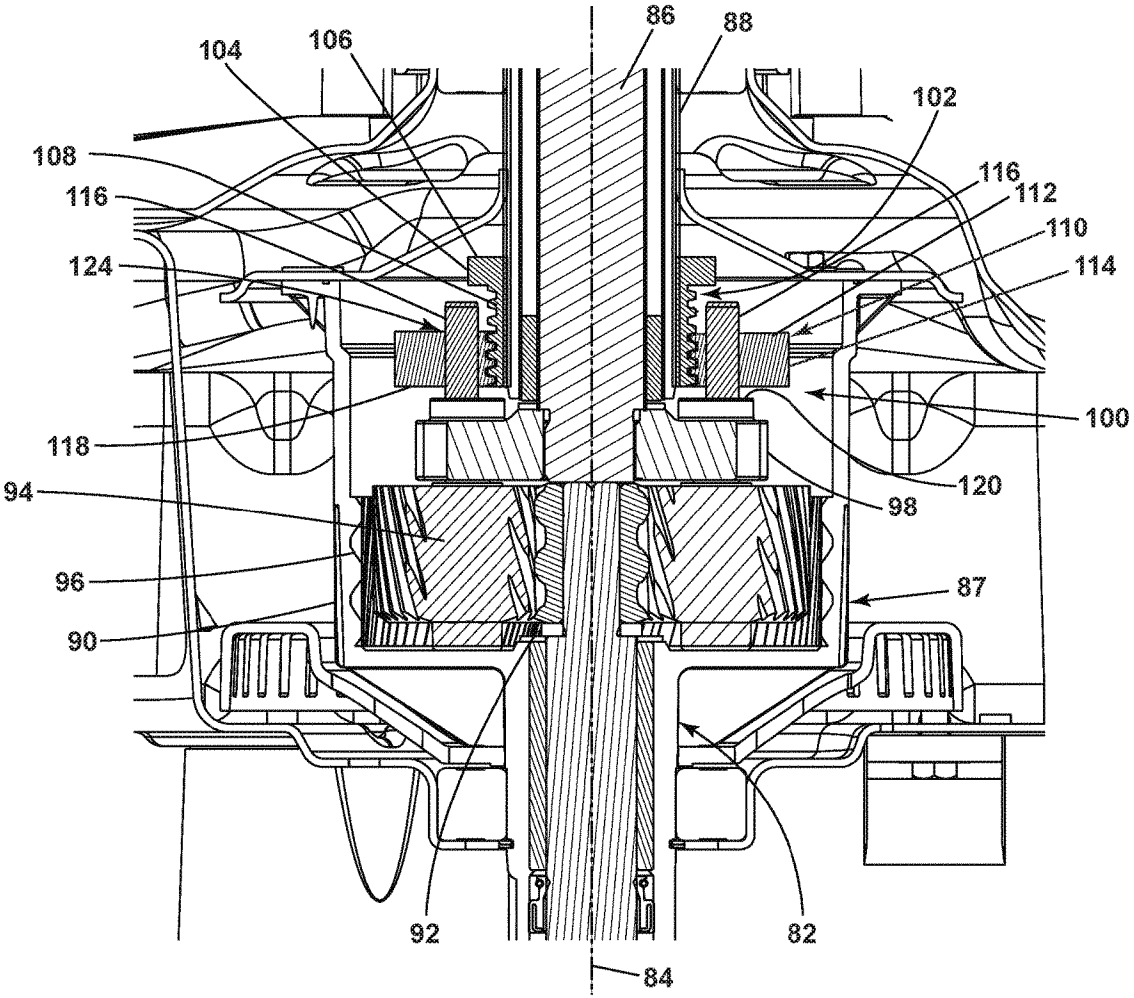
FIG. 4 illustrates a helical clutch that can be utilized in the loss motion device of FIG. 3.

Turning now to FIG. 4, the clutch mechanism 100 is shown in enlarged detail. The clutch mechanism 100 comprises a first threaded ring 102 that is illustrated as a radially inner threaded ring mounted circumferentially about a portion of the spin tube 88. A stop 104 is provided, which can be positioned at the upper surface 106 of the first threaded ring 102. The stop 104 is illustrated herein as being a flat portion that extends radially outward from the spin tube 88 and has a width greater than that of a radially inner threaded portion 108 of the first threaded ring 102. It will be understood that any alternate suitable geometry or structure can be used to form the stop 104 that effectively terminates the threaded portion 108 of the first threaded ring 102 and prevents further upward movement of any threadably mounted counterpart. The stop 104 can also be provided with sound deadening properties to eliminate a sound from being generated when a threadably mounted counterpart contacts the stop 104. Non-limiting examples of suitable sound deadening approaches include that the stop 104 itself can be formed of a sound deadening material, or that the stop 104 can have a sound deadening material, such as a pad or coating, applied to the stop 104 to prevent noise transmission.

It is also contemplated that the stop 104 can be positioned at any suitable location on the first threaded ring 102. By way of example, the stop 104 can be located at an upper end or a lower end of a first threaded ring 102. The first threaded ring 102 can also be provided with a stop 104 at both the upper end and the lower end in order to limit both upward movement at an upper end and downward movement at a lower end of any threadably mounted counterpart. It will be further understood that the first threaded ring 102 can be provided with a stop 104 at only one end, with the other end of the first threaded ring 102 having a thread pattern that allows a threadably mounted counterpart to freely rotate without having a stop 104 to restrict rotational movement. In this case, rotational movement of a threadably mounted counterpart would only be terminated after a sufficient amount of rotation in one direction (e.g., clockwise), but unlimited rotation is permitted in the other direction (e.g., counter-clockwise).

A helical tang, illustrated as a second threaded ring 110 is threadably mounted about the threaded portion 108 of the first threaded ring 102. The second threaded ring 110 is axially movable relative to the first threaded ring 102. The second threaded ring 110 has an upper surface 112 that faces the stop 104 of the first threaded ring 102. The second threaded ring 110 has an outer edge 114 that is located radially away from the spin tube 88. There are vertically-oriented through openings 124 within the second threaded ring 110 that are located radially inward from the outer edge 114. The second threaded ring 110 is threadably mounted about the first threaded ring 102 for axial motion along the vertical height of the threaded portion 108 of the first threaded ring 102. While the second threaded ring 110 is illustrated as having a circular outer profile, it will be understood that any suitable shape can be used, non-limiting examples of which include a triangular or square outer profile, so long as the inner opening of the second threaded ring 110 is complementary to the shape of the threaded portion 108 of the first threaded ring 102 for threadable mounting thereon.

The carrier 98 to which the planet gears 94 are coupled is provided with a set of pins 116 that extend vertically upward from the carrier 98. The pins 116 extend through the openings 124 within the second threaded ring 110, operably coupling the second threaded ring 110 with the rotation of the carrier 98 and providing a guide for the axial movement of the second threaded ring 110 along the first threaded ring 102. The pins 116 also are configured to stop the axial movement of the second threaded ring 110 in a downward direction. More specifically, when the second threaded ring 110 is in its lowermost position, the pins 116 of the carrier 98 prevent further downward motion. It will be understood that further downward motion of the second threaded ring 110 can also be prevented by the first threaded ring 102 of the clutch having a thread pattern at its lowermost end that is configured to allow the second threaded ring 110 to rotate freely, such that continued rotation does not result in coupling. Any suitable number of pins 116 can be provided on the carrier 98, including a single pin 116.

The washing machine 10 can perform one or more manual or automatic treating cycles or cycle of operation. A common cycle of operation includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases. Agitation may be employed during any of these phases, but is particularly suitable for the wash phase, as agitation may impart mechanical action on a laundry load that improves cleaning performance.

Turning now to the operation of the drive system 40 and clutch assembly 100, the motor 41 is configured to drive the clothes mover 38 to rotate. Further, as the motor 41 drives the rotation of the drive shaft 82 in the first direction, the rotation is transferred through the gear assembly of the sun gear 92, planet gears 94, and ring gear 96 to drive rotation of the carrier 98. Rotation of the carrier 98 in turn threads the second threaded ring 110 about the first threaded ring 102 such that the second threaded ring 110 moves axially upward along the pins 116. When the second threaded ring 110 reaches the uppermost edge of the threaded portion 108 of the first threaded ring 102, the second threaded ring 110 abuts the stop 104 of the first threaded ring 102 and further upward movement of the second threaded ring 110 is prevented. The interface between the second threaded ring 110 and the stop 104 results in the spin tube 88 and the first drive shaft 86 being locked together such that the clothes mover 38 and the basket 30 become rotationally coupled and further rotations in the same first direction result in rotary motion of the clothes mover 38 along with the basket 30.

When the motor 41 drives the rotation of the drive shaft 82 in a second, opposite direction, the clothes mover 38 is also driven to rotate in the second, opposite direction. As described previously, rotation is transferred through the gear assembly of the sun gear 92, planet gears 94, and ring gear 96 to drive rotation of the carrier 98. Rotation of the carrier 98 in turn threads the second threaded ring 110 about the first threaded ring 102 such that the second threaded ring 110 moves axially downward along the pins 116. When the second threaded ring 110 has moved downwardly away from the stop 104 of the first threaded ring, the spin tube 88 and the drive shaft 82 disengage from their locked together position such that further rotations of the drive shaft 82 in the second direction result in rotary motion of the clothes mover 38 alone, without concurrent rotation of the basket 30. When the second threaded ring 110 reaches the lowermost portion of the threaded portion 108 of the first threaded ring 102, the second threaded ring 110 abuts the lowermost edge of the pins 116, preventing further axial movement of the second threaded ring 110 in a downward direction and allowing for rotation of the clothes mover 38 independently of the basket 30. Continued rotation in the second direction by the clothes mover 38 could, in certain implementations, couple the clothes mover 38 and the wash basket 30. Alternatively, a braking mechanism could be implemented, which may lock the clothes mover 38 from further rotation in the second direction.

The first threaded ring 102 has a threaded portion 108 having a predetermined length, having a predetermined number of threads, and having threads with a predetermined pitch angle. These predetermined parameters may be selected by the manufacturer, and they impact the total number of full rotations of the clothes mover 38 before the clothes mover 38 and the basket 30 are rotationally coupled together. For example, a shallower pitch angle will result in a greater total number rotations of the clothes mover 38 being required as compared to a steeper pitch angle. This is because a steeper pitch angle will cause the second threaded ring 110 to rise at a faster rate, and thereby contact the stop 104 without requiring as many rotations. Similarly, the length of the threaded portion 108 and the number of threads disposed on the threaded portion 108 may impact the number of rotations of the clothes mover 38 before rotational coupling.

Figure 5B:
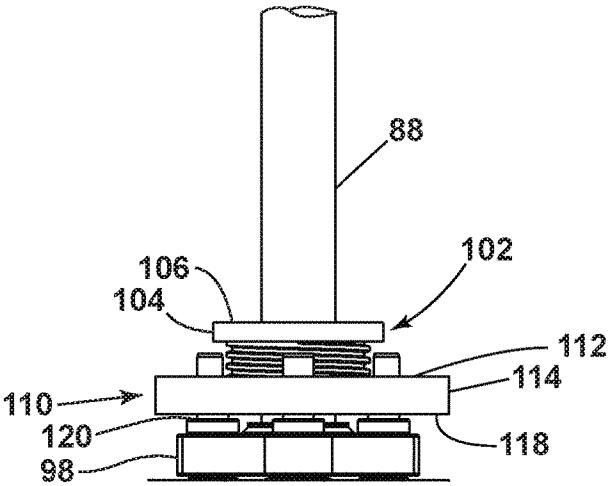
FIGS. 5A-5D illustrate a portion of a drive system and axial positions of the helical clutch of FIG. 4.
Figure 5A:
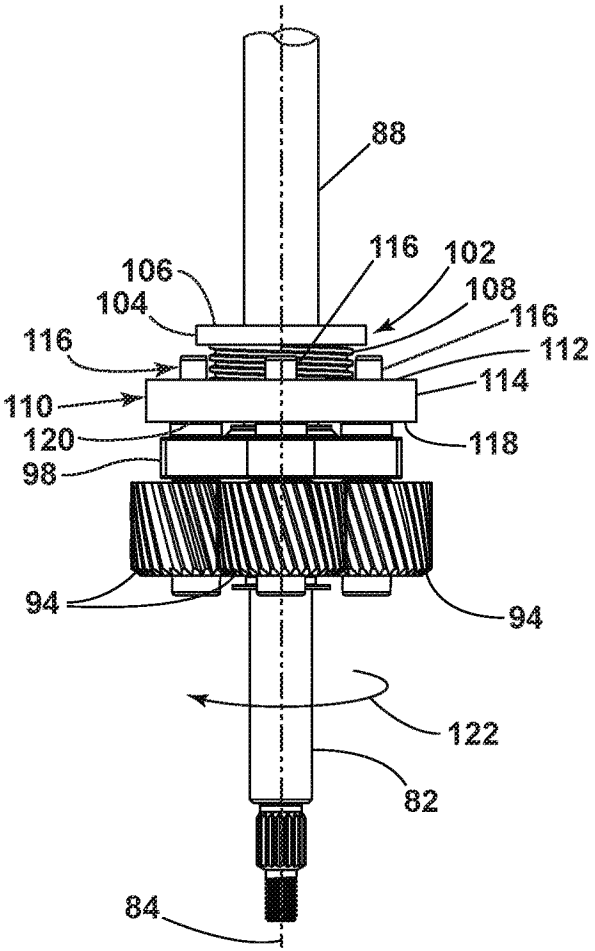
Figure 5D:
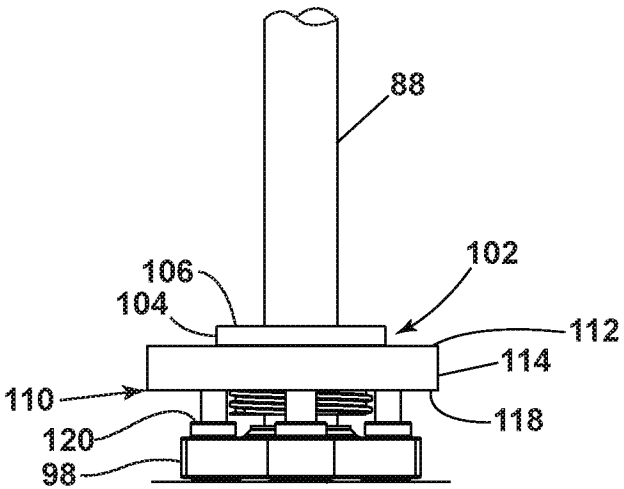
Figure 5C:
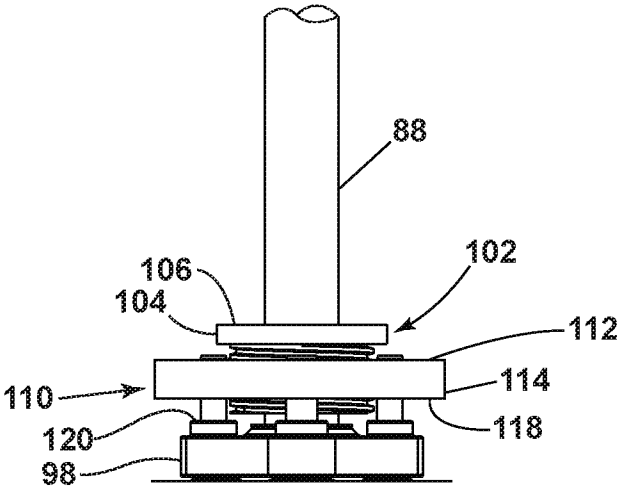

The axial movement of the second threaded ring 110 can be seen in FIGS. 5A-5D. For example, in FIG. 5A, the second threaded ring 110 occupies a first, lower-most position. As depicted, a lower surface 118 of the second threaded ring 110 abuts the upper surface 120 of the carrier 98. If the clothes mover 38 and the drive shaft 82, which moves therewith, are rotated in a clockwise direction, as illustrated by the arrow 122, then the second threaded ring 110 moves away from the upper surface 120 of the carrier 98 along the vertical height of the pins 116. FIG. 5B illustrates the second threaded ring 110 after continued axial movement in response to continued clockwise rotation by the clothes mover 38. FIG. 5C shows still further axial movement by the second threaded ring 110 in response to still further clockwise rotation by the clothes mover 38. Finally, FIG. 5D shows the second threaded ring 110 occupying an uppermost position. Once in this position, any additional rotational motion of the clothes mover 38 in the clockwise direction, as illustrated by arrow 122, results in rotational coupling of the clothes mover 38 and the basket 30 such that they will rotate together. Thus, the second threaded ring 110 is able to axially rise to selectively couple and uncouple, respectively, the clothes mover 38 and the basket 30.

As mentioned, the number of rotations by the clothes mover 38 after which the above-described coupling occurs will depend on various parameters, including the length, number of threads, and thread pitch angle of the threaded portion 108. These parameters can all be tailored to enable any desired stroke angle. For example, in illustrative implementations, rotational engagement between the clothes mover 38 and the basket 30 occurs after the clothes mover 38 has completed the one, two, three, or four rotations. This provides the benefit of a large range of motion for the clothes mover 38 during agitation. In certain implementations, engagement can occur after partial rotations. In exemplary implementations, in a wash phase or agitate phase, the clothes mover 38 is oscillated through an angle of approximately 170 degrees to 680 degrees during each stroke.

Oftentimes it is desirable to hold the basket 30 fixed relative to the tub 34 during the agitate mode and to do this the brake mechanism (not shown) is left in an operational condition. However, during the water extraction step or spin step, the basket 30 is spun with the clothes mover 38 and any brake mechanism can be released from frictional engagement with the basket 30.

It should also be understood that rotation of the clothes mover 38 may also move the second threaded ring 110 to previous positions such that the movement of the clothes mover 38 and the second threaded ring 110 is reversible. For example, if the second threaded ring 110 occupies the position depicted in FIG. 5D and the clothes mover 38 rotates in a counter-clockwise direction by an amount greater than or equal to 360 degrees, the second threaded ring 110 can move axially down (e.g., to the position depicted in FIG. 5C). In such an instance, when the clothes mover 38 is rotated in the opposite direction, the second threaded ring 110 can move in an opposite manner until the second threaded ring 110 and the upper surface 120 of the carrier 98 are locked in the counter-clockwise direction.

Figure 6:
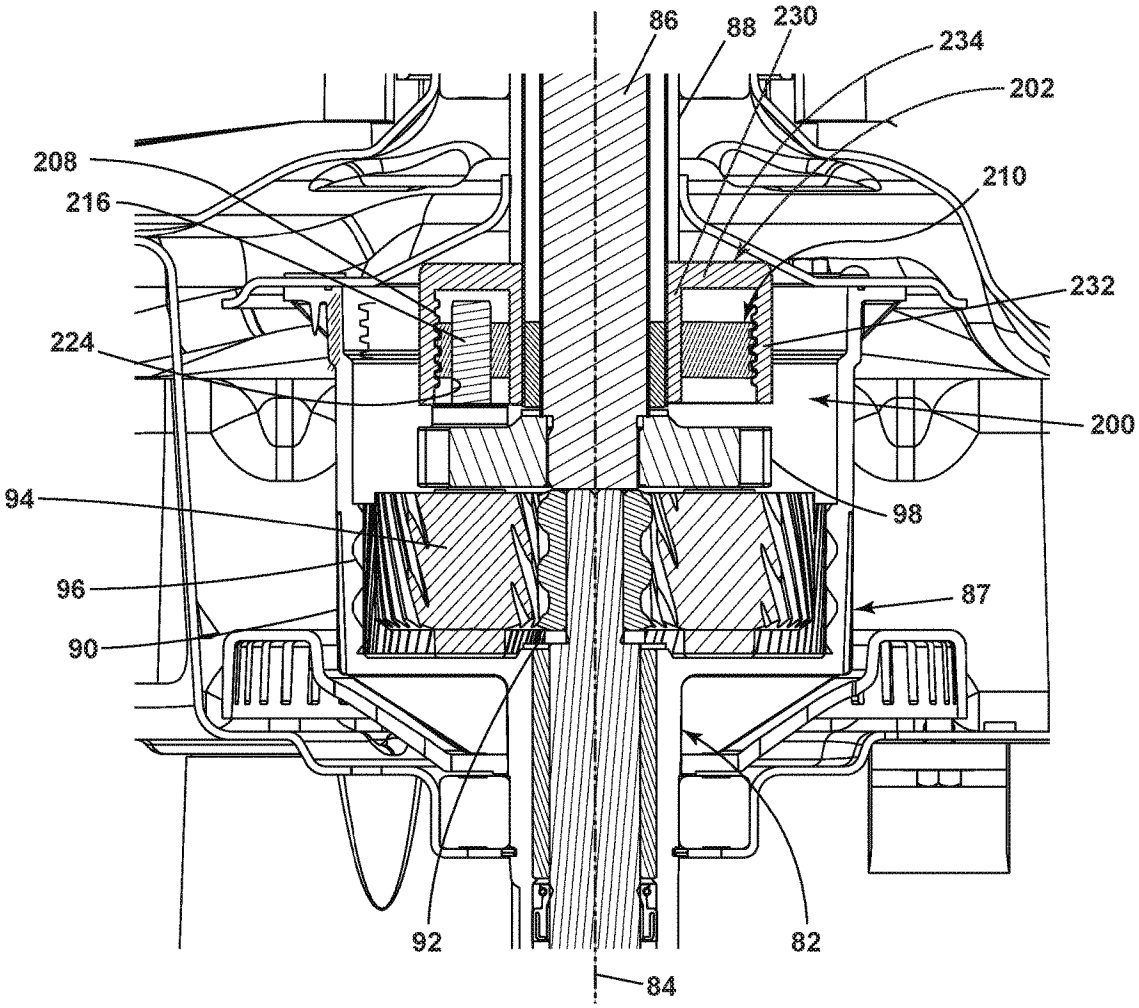
FIG. 6 illustrates an additional embodiment of a helical clutch that can be utilized in the loss motion device of FIG. 3.
Figure 7:
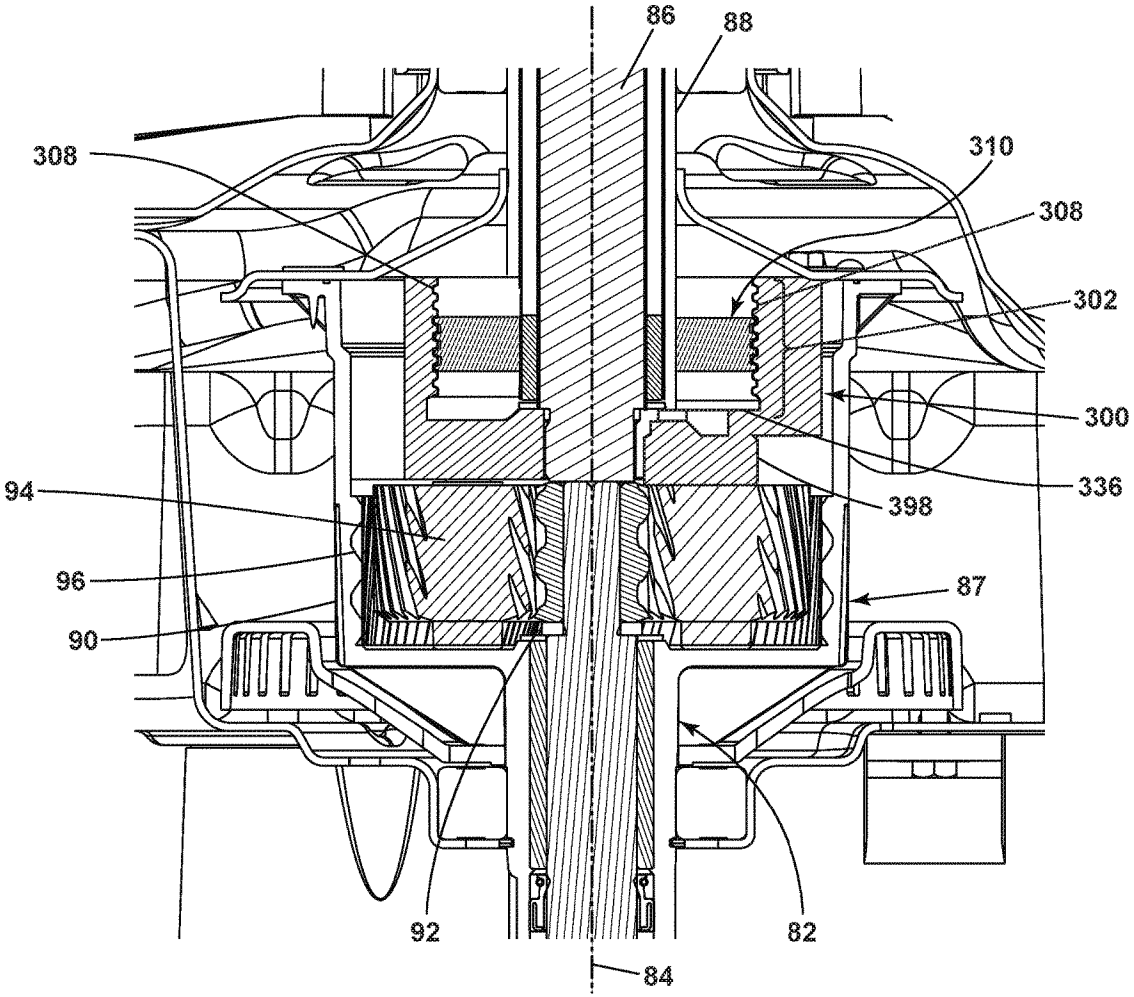
FIG. 7 illustrates an additional embodiment of a helical clutch that can be utilized in the loss motion device of FIG. 3.

FIGS. 6-7 illustrate additional embodiments of the invention comprising clutch mechanisms 200 (FIG. 6), 300 (FIG. 7), which are similar to the first clutch mechanism 100 except for the axially movable threaded ring. Therefore, elements in the clutch mechanisms 200, 300 similar to those of the clutch mechanism 100 will be numbered with the prefix 200 (FIG. 6) or 300 (FIG. 7), respectively.

FIG. 6 illustrates a clutch mechanism 200 according to an additional embodiment of the invention. In this embodiment, the second threaded ring 210, which is still threadably mounted with the first threaded ring 202, not only receives the pins 216 that extend upwardly from the carrier 98 within its openings 224, but is also fixedly mounted to the pins 216 such that there is no axial movement of the second threaded ring 210 relative to the pins 216. The first threaded ring 202, which is located circumferentially about a portion of the spin tube 88, is axially moveable upwardly and downwardly along the height of the spin tube 88, while the second threaded ring 210 remains axially stationary. The first threaded ring 202 in this embodiment is provided as a cylindrical ring having an inner wall 230, an outer wall 232 spaced from and parallel to the inner wall 230, and an upper wall 234 extending between and connecting the inner wall 230 and outer wall 232. The threaded portion 208 of the first threaded ring 202 is provided along the inner diameter of the outer wall 232.

In operation, as the motor 41 drives the rotation of the drive shaft 82 in a first direction, the rotation is transferred through the gear assembly of the sun gear 92, planet gears 94, and ring gear 96 to drive rotation of the carrier 98. Rotation of the carrier 98 in turn rotates the second threaded ring 210 via the mechanical engagement between the pins 216 and the second threaded ring 210. As the second threaded ring 210 rotates, it remains axially stationary while the threaded engagement of the first threaded ring 202 with the rotating second threaded ring 210 drives the axial movement of the first threaded ring 202 relative to the second threaded ring 210. The first threaded ring 202 moves axially according to the thread pattern at the interface between the first threaded ring 202 and the second threaded ring 210. The first threaded ring 202 can move axially upward, away from the carrier 98 until the thread pattern at the lowermost end of the threaded portion 208 of the first threaded ring 202 prevents further upward motion. The thread pattern at the lowermost end of the threaded portion 208 can either prevent further axial motion of the first threaded ring 202 by coupling of the first threaded ring 202 and the second threaded ring 210 such that no further axial motion occurs in the same direction, or the thread pattern can allow for continued rotation of the second threaded ring 210 in the absence of further axially upward motion of the first threaded ring 202. When rotation of the second threaded ring 210 is driven in a second, opposite direction, the first threaded ring 202 can move axially downward, toward the carrier 98, until the second threaded ring 210 contacts the upper wall 134 of the first threaded ring 202 and further downward axial motion is prevented. In this way, when the first threaded ring 202 has moved axially upward or downward until it meets a stop, coupling or decoupling of the basket 30 and the clothes mover 38 can occur.

FIG. 7 illustrates a clutch mechanism 300 according to an additional embodiment of the invention. In this embodiment, the second threaded ring 310 is mounted circumferentially about a portion of the spin tube 88 in such a way that axial movement of the second threaded ring 310 relative to the carrier 398 is permitted. In this way, the second threaded ring 310 does not rotate about the spin tube 88, but can move axially relative to the carrier 398. In this embodiment, the second threaded ring 310 is not provided with through openings as in previous embodiments, nor are there pins extending upwardly from the carrier 398 as before. The first threaded ring 302 is provided in this embodiment as extending upwardly from the carrier 398, such that the first threaded ring 302 is actually an extended upper portion of the carrier 398. Rather than having pins extended upwardly from the carrier 398 as in previous embodiments, the first threaded ring 302 extends upwardly from the carrier 398 and has a ring shape that is provided circumferentially about the second threaded ring 310. Along the inner circumference of the first threaded ring 302 portion of the carrier 398 is provided the threaded portion 308 that is in threaded engagement with the second threaded ring 310.

In operation, as the motor 41 drives the rotation of the drive shaft 82 in a first direction, the rotation is transferred through the gear assembly of the sun gear 92, planet gears 94, and ring gear 96 to drive rotation of the carrier 398. Rotation of the carrier 398 in turn rotates the first threaded ring 302 portion via mechanical attachment. As the first threaded ring 302 rotates, it remains axially stationary while the threaded engagement of the second threaded ring 310 with the rotating first threaded ring 302 drives the axial movement of the second threaded ring 310 relative to the carrier 398. The second threaded ring 310 moves axially according to the thread pattern at the interface between the second threaded ring 310 and the first threaded ring 302. The second threaded ring 310 can move axially upward, away from the carrier 398, until the thread pattern at the uppermost end of the threaded portion 308 of the first threaded ring 302 prevents further upward motion. The thread pattern at the uppermost end of the threaded portion 308 can either prevent further axial movement of the second threaded ring 310 by coupling of the first threaded ring 302 and the second threaded ring 310 such that no further axial motion occurs in the same direction, or the thread pattern can allow for continued rotation of the first threaded ring 302 in the absence of further axially upward motion of the second threaded ring 310. When rotation of the first threaded ring 302 is driven in a second, opposite direction, the second threaded ring 310 can move axially downward, toward the carrier 398, until the second threaded ring 310 contacts a lower surface 336 of the first threaded ring 202 and further downward axial motion of the second threaded ring 310 is prevented. In this way, when the second threaded ring 310 has moved axially upward or downward until it meets a stop, coupling or decoupling of the basket 30 and the clothes mover 38 can occur.

It will be understood that any suitable clutch assembly comprising two threadably engaged rings is within the scope of the invention. More specifically, the clutch assembly according to the disclosure herein, can be any two-ring assembly in which one ring is provided circumferentially wrapped about the other ring, with the two rings having a threaded relationship with one another to move relative to each other, and wherein at least one of the rings is axially moveable until it reaches a stop. Such a clutch assembly can be achieved with either an axially movable inner ring, an axially movable outer ring, or both the inner and outer rings could allow some axial movement.

In a traditional vertical axis laundry treating appliance, the drive system is a significant contributor to cost and complexity. For example, current appliances can include a synchronous motor to go from agitation to spin, which costs roughly four dollars and another fifty cents to interface with the drive system. The various aspects described herein removes the splined clutch components and shift actuator in favor of a simple loss motion device or helical tang clutch. This allows independent motion of the clothes mover for wash and then engagement of the clutch for extraction spin. Aspects of the present disclosure provide similar performance to contemporary appliances while reducing the transmission system and costs related thereto. Such a reduction can also result in a stack height reduction of the wash unit and the drive system along with maintained or increased capacity.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance comprising:

a rotatable basket with a spin tube;

a rotatable clothes mover located within the rotatable basket;

a motor having a drive shaft extending through the spin tube and operably coupled to the clothes mover;

a drive system selectively rotatably coupling the spin tube and the drive shaft and comprising:

a first threaded ring located about the spin tube;

a second threaded ring threaded about the first threaded ring wherein at least one of the first threaded ring or the second threaded ring is axially moveable relative to the other; and a gear assembly rotationally coupled to the drive shaft;

wherein rotation of the drive shaft is configured to axially move the at least one of the first threaded ring or the second threaded ring and when either the first threaded ring or the second threaded ring abuts a stop, continued rotation in a same direction results in the spin tube and drive shaft being locked together for coupled rotary motion of the clothes mover and the basket.

2. The laundry treating appliance of claim 1, further comprising a carrier having multiple pins extending into openings in the second threaded ring, wherein the second threaded ring axially moves up and down along the pins in response to rotation of the drive shaft.

3. The laundry treating appliance of claim 2 wherein the gear assembly is a planetary gear system having planetary gears that drive rotation of the carrier.

4. The laundry treating appliance of claim 2 wherein the first threaded ring is mounted to the spin tube and the first threaded ring forms the stop configured to prevent further axial movement of the second threaded ring.

5. The laundry treating appliance of claim 2 wherein the carrier is configured to stop axial movement of the second threaded ring in an axial direction.

6. The laundry treating appliance of claim 1 wherein the first threaded ring is axially movable up and down along the spin tube.

7. The laundry treating appliance of claim 6 wherein the second threaded ring is configured to drive axial movement of the first threaded ring up and down while the second threaded ring remains in a same axial position.

8. A laundry treating appliance, comprising:
a tub defining an interior;
a basket with a spin tube located within the interior and rotatably mounted within the tub;
a clothes mover rotatably mounted within the basket;
a motor having a drive shaft extending through the spin tube and operably coupled to the clothes mover to selectively oscillate or rotate the clothes mover; and
a clutch assembly having a first threaded clutch ring mounted to the spin tube and a second threaded ring operably coupled to the drive shaft and threaded about the first threaded clutch ring;
wherein the second threaded ring moves axially about the first threaded clutch ring and the clutch assembly is configured to rotationally couple the clothes mover and the basket after the clothes mover has moved through a predetermined stroke angle.

9. The laundry treating appliance of claim 8 wherein the second threaded ring moves axially about the first threaded clutch ring in response to successive full rotations of the clothes mover until the second threaded ring reaches a stop on the first threaded clutch ring and engagement between the second threaded ring and the stop causes rotational coupling of the clothes mover and the basket.

10. The laundry treating appliance of claim 9 wherein the stop is at a top of the first threaded clutch ring.

11. The laundry treating appliance of claim 10, further comprising a thread pattern at a bottom of the first threaded clutch ring that is configured to allow the second threaded ring to freely rotate, such that continued rotation does not result in coupling.

12. The laundry treating appliance of claim 10, further comprising:
a second stop at a bottom of the first threaded clutch ring; wherein
the second threaded ring moves axially about the first threaded clutch ring in response to successive full rotations of the clothes mover in an opposite direction until the second threaded ring reaches the second stop on the first threaded clutch ring; and
engagement between the second threaded ring and the stop causes rotational coupling of the clothes mover and the basket.

13. The laundry treating appliance of claim 9 wherein the stop further comprises sound deadening material such that the second threaded ring engages the sound deadening material of the stop.

14. The laundry treating appliance of claim 8, further comprising a planetary gear mechanism rotationally coupling the drive shaft to the second threaded ring.

15. The laundry treating appliance of claim 14 wherein the planetary gear mechanism comprises:
a sun gear;
a plurality of planet gears driven by the sun gear; and
a planet carrier driven by the plurality of planet gears; and
wherein the motor is operably connected to the sun gear and the second threaded ring is operably connected to the planet carrier.

16. The laundry treating appliance of claim 8 wherein the clothes mover is configured to oscillate through a stroke of more than 360 degrees before the clothes mover and the basket are rotationally coupled together.

17. The laundry treating appliance of claim 16 wherein the clothes mover is configured to oscillate through a stroke of more than 720 degrees before the clothes mover and the basket are rotationally coupled together.

18. The laundry treating appliance of claim 17 wherein the clothes mover is configured to oscillate through a stroke of more than 1080 degrees before the clothes mover and the basket are rotationally coupled together.

19. A laundry treating appliance, comprising:
a basket with a spin tube;
a clothes mover rotatably mounted within the basket;
a motor having a motor input drivingly coupled to the clothes mover, through the spin tube, to selectively oscillate or rotate the clothes mover;
a clutch assembly having a vertically moveable tang configured to move along an axial length; and
a drive mechanism comprising:
a sun gear operably connected with the motor;
a plurality of planet gears driven by the sun gear; and
a planet carrier rotatably driven by the plurality of planet gears and operably connected with the vertically moveable tang to move the vertically moveable tang along the axial length; and wherein:
the clutch assembly is configured to permit oscillatory motion of the clothes mover and rotary motion of the clothes mover and the basket; and
the clothes mover moves through an available oscillatory stroke angle before the clothes mover and the basket are locked together for rotary motion; and
the available oscillatory stroke angle of the clothes mover corresponds to the vertically moveable tang moving along the axial length before the clothes mover and the basket are locked together when the vertically moveable tang reaches an end of the axial length.

20. The laundry treating appliance of claim 19 wherein the available oscillatory stroke angle is based on a length of a threaded portion of the vertically moveable tang, a number of threads on the threaded portion of the vertically moveable tang, and a pitch angle of the threads on the threaded portion of the vertically moveable tang.

21. The laundry treating appliance of claim 19 wherein the clutch assembly further comprises a radially inner threaded ring and a radially outer threaded ring one of which defines the vertically moveable tang and the other of which is axially stationary.

22. A laundry treating appliance comprising:
a rotatable basket with a spin tube;
a rotatable clothes mover located within the rotatable basket;
a motor having a drive shaft extending through the spin tube and operably coupled to the clothes mover;
a drive system selectively rotatably coupling the spin tube and the drive shaft and comprising:
a first threaded ring located about the spin tube;

a second threaded ring threaded about the first threaded ring wherein at least one of the first threaded ring or the second threaded ring is axially moveable relative to the other;

a gear assembly rotationally coupled to the drive shaft; and a carrier having multiple pins extending into openings in the second threaded ring;

wherein the second threaded ring axially moves up and down along the pins in response to rotation of the drive shaft and when either the first threaded ring or the second threaded ring abuts a stop, continued rotation in a same direction results in the spin tube and drive shaft being locked together for coupled rotary motion of the clothes mover and the basket.

* * * * *